US007503775B2

(12) United States Patent
Golberg et al.

(10) Patent No.: US 7,503,775 B2
(45) Date of Patent: Mar. 17, 2009

(54) INTEGRATED PROTECTION CIRCUIT

(75) Inventors: Hans-Joachim Golberg, Ulm (DE); Meik Wilhelm Widmer, Elchingen (DE)

(73) Assignee: Atmel Germany GmbH, Heilbronn (DE)

( * ) Notice: Subject to any disclaimer, the term of this patent is extended or adjusted under 35 U.S.C. 154(b) by 0 days.

(21) Appl. No.: 11/850,632

(22) Filed: Sep. 5, 2007

(65) Prior Publication Data

US 2008/0113533 A1 May 15, 2008

Related U.S. Application Data

(60) Provisional application No. 60/842,048, filed on Sep. 5, 2006.

(51) Int. Cl.
*H01R 4/66* (2006.01)

(52) U.S. Cl. ..... 439/92

(58) Field of Classification Search ..... 439/92; 361/111, 56, 91; 257/723, 724, 777, 310
See application file for complete search history.

(56) References Cited

U.S. PATENT DOCUMENTS

| | | | | |
|---|---|---|---|---|
| 5,528,188 | A * | 6/1996 | Au et al. | 327/310 |
| 6,064,095 | A * | 5/2000 | Fu | 257/355 |
| 6,873,505 | B2 | 3/2005 | Chen et al. | |
| 7,067,914 | B2 * | 6/2006 | Malinowski et al. | 257/723 |
| 7,336,460 | B2 * | 2/2008 | Dournelle et al. | 361/56 |

* cited by examiner

*Primary Examiner*—Jean F Duverne
(74) *Attorney, Agent, or Firm*—Muncy, Geissler, Olds & Lowe, PLC

(57) ABSTRACT

An integrated protection circuit is provided to protect an integrated component against an electrostatic discharge with a conductive structure between the integrated component and a housing terminal, whereby two substantially parallel conductive sections of the conductive structure guide the electrostatic discharge in a preferential direction by inductive coupling.

11 Claims, 2 Drawing Sheets

INTEGRATED PROTECTION CIRCUIT

This nonprovisional application claims priority to U.S. Provisional Application No. 60/842,048, which was filed on Sep. 5, 2006, and is herein incorporated by reference.

BACKGROUND OF THE INVENTION

1. Field of the Invention

The present invention relates to an integrated protection circuit to protect against an electrostatic discharge current (ESD) and an integrated oscillator circuit of a global positioning system (GPS).

2. Description of the Background Art

A protection structure for an integrated protection circuit to protect against an electrostatic discharge (ESD—electrostatic discharge) is shown in U.S. Pat. No. 6,873,505 B2, which also explains a protection circuit for electrostatic discharges. The protection structure is connected to a common discharge line (CDL). In an exemplary embodiment of U.S. Pat. No. 6,873,505 B2, the semiconductor component comprises a plurality of bond pads, each of which is assigned a protection circuit with a protection structure. For protection, a controlled semiconductor rectifier (SCR), which can also be called a thyristor, is provided, whose triggering voltage is reduced by a Zener diode as the triggering element.

SUMMARY OF THE INVENTION

It is therefore an object of the present invention to provide an integrated protection circuit, which reduces the likelihood that a pulse of an electrostatic discharge reaches a component to be protected, whereby a connection between the component to be protected and a housing terminal is to be made as low-impedance as possible.

It is possible to design the protection circuit with several protection regions. A first protection region can be formed, for example, by a first number of protection structures in the area of a connection region of the affected housing terminals. These protection structures of the first number conduct electrostatic pulses away, so that ideally no current reaches the component to be protected. A second protection stage can be formed by a second protection region, in that the second protection region in the area of the component to be protected has a second number of protection structures. A conductive structure is made between the component to be protected and the housing terminals; during normal operation this structure can transfer useful voltages and/or useful currents.

Consequently, an integrated protection circuit is provided for the protection of an integrated component against an electrostatic discharge (ESD). The integrated protection circuit has a conductive structure between the integrated component and a housing terminal.

During normal operation, useful voltages or useful currents can be brought into the component to be protected via the housing terminal. For this purpose, the component is connected in a low-impedance manner to the housing terminal. The housing terminal advantageously has a so-called pad for this purpose, which is made on the semiconductor chip. If a bond pad is used, the pad is connected to a metal lug of the terminal by means of a bond wire. Furthermore, solder can be applied to the pad for flip-chip mounting. Other connection technologies can also be used, however.

The integrated protection circuit has a conductive structure between the component and the housing terminal. Preferably, the conductive structure has low-impedance conductive sections. Advantageously, the conductive structure has a resistance less than 10 ohms between the component and the terminal. Preferably, the conductive structure is formed by metal tracks. Alternatively or in combination, the conductive sections can be made of a highly doped and thereby low-impedance semiconductor material, such as, for example, highly n-doped polycrystalline silicon. Advantageously, the conductive structure has one or more wiring levels with a via for connection between two wiring levels.

Two substantially parallel conductive sections of the conductive structure guide the electrostatic discharge in a preferential direction by inductive coupling. The preferential direction in this case is the desired local course of the discharge current flow along a planned path. The preferential direction thereby advantageously does not lead across the component to be protected.

Within the meaning of the invention, thereby, the two conductive sections are then regarded as substantially parallel when the first conductive section and the second conductive section are structured geometrically at such an angle that a discharge current generated by the electrostatic discharge in the first conductive section induces a current in the second conductive section in the preferential direction by inductive coupling. Thus, an acute angle smaller than 15° between the two conductive sections still meets the parallelism requirement, so that there still is a sufficient inductive coupling between the first conductive section and the second conductive section. Preferably, for a best possible inductive coupling, the first conductive section and the second conductive section are arranged positioned at a small distance to one another. An insulator, particularly of a dielectric, is formed between the first conductive section and the second conductive section; this insulator insulates these sections electrically from one another, but enables an inductive coupling.

An embodiment provides that the conductive structure has a substantially straight conductive section for an electrostatic discharge current. Furthermore, the conductive structure in this variant of a further development has a branch connected to the component to be protected from the substantially straight conductive section, whereby the branch forms an angle to the substantially straight conductive section.

A substantially straight conductive section within the meaning of this further development means that the conductive structure has a conductive section with the geometry similar to a straight line. The conductive structure preferably connects a protection structure with the housing terminal. This connection is made preferably to be low-impedance. In this variant of a further development, the conductive structure has a branch made at an angle from this conductive section, said branch which is connected to the component to be protected.

A conductive section similar to a straight line can deviate from a mathematical straight line, for example, as a curved shape with very large radius. A conductive section, which deviates from a precise mathematical straight line due to manufacturing tolerances, is nevertheless also made substantially straight within the meaning of the invention. It is only a matter here that the branch branches from the conductive section at a definite angle, so that a direction of a discharge current follows predominantly the conductive section formed as a straight line. An embodiment of the variant of a further development provides that the angle of the branch is between 45° and 135°. This type of angle produces a current obstruction at an edge between the branch and the substantially straight conductive section, so that the current preferably follows the substantially straight conductive section.

A variant of a further development provides that the substantially straight conductive section connects the two substantially parallel conductive sections. By this means, both physical effects of the obstruction of the current at the edge region of the branch and the inductive coupling are advantageously combined.

According to a variant of a further development, the component to be protected has a p-n junction, which is connected to the housing terminal. Hereby, the p-n junction is to be protected particularly against discharge currents, which can flow in the blocking direction across the p-n junction. Preferably, the n-doped semiconductor region of the p-n junction is connected to a first housing terminal and the p-doped semiconductor region of the p-n junction to the second housing terminal by the conductive structure.

Another variant provides that the integrated protection circuit has a first number of integrated protection structures in the connection region of the housing terminal. The number hereby is at least one, so that at least one protection structure is provided in the connection region. A specific protection structure can be made in very different ways in this case. U.S. Pat. No. 6,873,505 B2 discloses thereby only one special type of a plurality of different protection structure types, which depending on the application may be used for the protection circuit. The connection region hereby is an area on the semiconductor chip, which is disposed closer to a pad of the housing terminal than to the component.

Furthermore, the integrated protection circuit has a second number of integrated protection structures in the vicinity of the component to be protected. In this case, the vicinity of the component to be protected is made closer to the component to be protected than to the pad of the housing terminal. In the vicinity of the component to be protected at least one protection structure is provided that protects the component. Advantageously, the connection area and the vicinity of the component to be protected are disposed at a distance to one another.

It is provided that the conductive structure connects the component to be protected and the housing terminal to one another.

A first of different further aspects provides that the branch and the conductive section are formed within one metallization level. The angle in this case can be defined simply by masking during the manufacturing process of the integrated protection circuit. According to a second further development variant, the conductive section is formed by a number of vias. The branch is formed in a metallization level substantially perpendicular to at least one of the number of vias. The conductive section thereby can be formed by a single via or advantageously by two or more vias arranged one on top of another.

In another further development, a diode protection structure of the second number of protection structures is connected antiparallel to the p-n junction. A diode protection structure is understood to be a protection structure that has a function similar to a diode, conducting the current further in the one direction, therefore in a low-impedance manner, but blocking the current in the opposite direction. Either the p-n junction or the diode protection structure in the blocking direction is therefore operated by the antiparallel circuit. Depending on the current flow direction, current flows through the diode protection structure or the p-n junction in the flow direction.

The previously described further development are especially advantageous both individually and in combination. In this regard, all further development variants can be combined with one another. Some possible combinations are explained in the description of the exemplary embodiments in the figures. These possibilities of combinations of the further development variants, depicted therein, are not definitive however.

Another object of the invention is to provide an integrated oscillator circuit, particularly for a device of a global positioning system (EPS) with a protection circuit. This object is achieved by the integrated oscillator circuit with the features of claim 11. This oscillator circuit as well can be improved further by the previously explained further development variants.

Accordingly, an integrated oscillator circuit particularly of a global positioning system is provided. This oscillator circuit has a p-n junction, housing terminals for a quartz for connecting to the p-n junction, and an integrated protection circuit, as was previously explained. Another subject of the invention is a use of a protection circuit in a receiving device of a global positioning system (GPS) with an antenna for receiving satellite signals, and with a receiving circuit, which has a previously explained oscillator circuit, with terminals for a quartz to generate a reference signal for the satellite signals.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
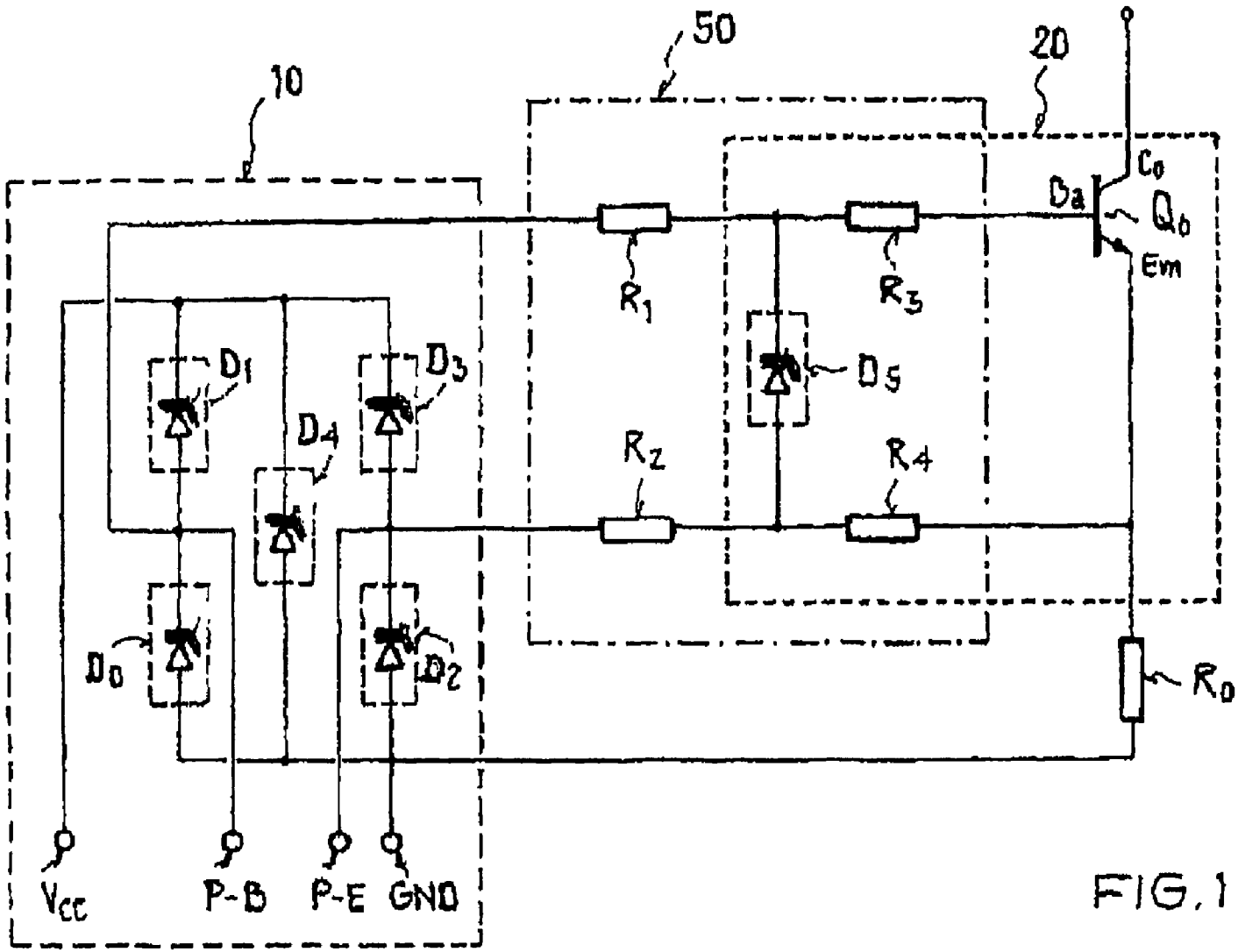
FIG. 1 is a schematic circuit diagram of a protection circuit.

FIG. 1 shows a circuit diagram of a protection circuit schematically. The component to be protected is shown as a bipolar transistor Q0 whose base Ba is connected to the first housing terminal P-B and whose emitter is connected to the second housing terminal P-E. The connection between the base Ba to the first housing terminal P-B is thereby formed by resistors R1 and R3. The connection between the emitter Em to the second housing terminal P-E is thereby formed by resistors R2 and R4.

The resistors R1, R2, R3, and R4 are formed by metal tracks of a conductive structure. These metal tracks are especially low-impedance, so that each of the resistors R1, R2, R3, and R4 has a resistance value less than 10 ohms. Because of the metal tracks of the conductive structure, an especially low-impedance terminal of the base Ba and of the emitter Em of the bipolar transistor Q0 can therefore be achieved. This type of low-impedance terminal is necessary, for example, for a circuit in which the bipolar transistor amplifies the high-frequency signal. For example, a quartz for a quartz oscillator can be connected to the emitter Em and the base Ba.

Two main cases can be differentiated if an electrostatic discharge occurs. In the first main case, an electron discharge reaches the first housing terminal P-B due to the electrostatic discharge. If the protection structures D0, D1, D2, D3, D4, and D5 were not present, the electrons of this electron discharge would reach the base Ba of the bipolar transistor Q0 via resistors R1 and R3. Due to this electron discharge, a base-emitter p-n junction of the bipolar transistor Q0 would be loaded in the blocking direction. Due to this loading, the base-emitter p-n junction could be disrupted even by small electrostatic discharges.

In the second main case, an electron discharge reaches the second housing terminal P-E due to the electrostatic discharge. If the protection structures D0, D1, D2, D3, D4, and D5 were not present, the electrons of this electron discharge would reach the emitter Em of the bipolar transistor Q0 via resistors R2 and R4. Due to this electron discharge, the base-emitter p-n junction of the bipolar transistor Q0 would be loaded in the flow direction. Very high electron discharge currents in this second main case as well would lead to the disruption of the base-emitter p-n junction.

To protect this p-n junction, a number of protection structures D0, D1, D2, D3, and D4 are therefore formed in a connection region 10 adjacent to the first housing terminal P-B and the second housing terminal P-E. These cause a draining off of the electrostatic discharge. The protection structures D0, D1, D2, and D3 thereby act similar to a diode function.

The mode of operation of the protection structures D0 to D4 will be explained hereafter using some examples. For example, the electrons of an electrostatic discharge reach the node between protection structures D0 and D1 from the first housing terminal P-B. D0 has a low-impedance effect for these electrons but D1 a high-impedance effect for these electrons. The electrons subsequently flow across D0 and reach protection structure D4.

Protection structure D4 as the only one of the protection structures of the exemplary embodiment of FIG. 1 is made to shift to the conductive state starting at a structurally inherent threshold voltage and to draw off the electrostatic discharge via protection structure D2 to second housing terminal P-E.

Electrons of an electrostatic discharge at the second housing terminal, in contrast, are drawn off via protection structures D3, D4, and DO to the first housing terminal P-B. A discharge pulse introduced via housing terminal GND is drawn off, for example, directly via protection structure D4 to housing terminal Vcc. In addition, naturally, still further drainages of electrostatic discharges are possible via protection structures D0 to D4.

Another protection structure D5 is formed in a vicinity 20 of the p-n junction near bipolar transistor Q0. The other protection structure D5 hereby also has the function of a diode. This diode function is connected antiparallel to the base-emitter p-n junction of bipolar transistor Q0 via resistors R3 and R4 made of metal tracks. Protection structure D5 blocks for electrons, which reach base Ba from emitter Em in the direction of flow.

If in contrast electrons in the blocking direction of the p-n junction reach the base Ba of the same, protection structure D5 forms a low-impedance conduction path, parallel to the blocking p-n junction. In this case, the flow of the current across protection structure D5 is the preferential direction for the electron current of the electrostatic discharge. The preferential direction across protection structure D5 therefore serves to protect the p-n junction from disruption.

The metal tracks, which form the conductive structure and thereby resistors R1, R2, R3, and R4, are formed in the exemplary embodiment of FIG. 1 in metallization levels 50, whereby a region of metallization levels 50 is indicated schematically by a dot-dash line. The metallization levels are known per se and therefore not explained in greater detail in the exemplary embodiment of FIG. 1. Furthermore, in FIG. 1 a resistor R0 is shown as a component of a circuit, not shown in greater detail in FIG. 1, with bipolar transistor Q0. This can be formed, for example, by a doped well.

Figure 2:
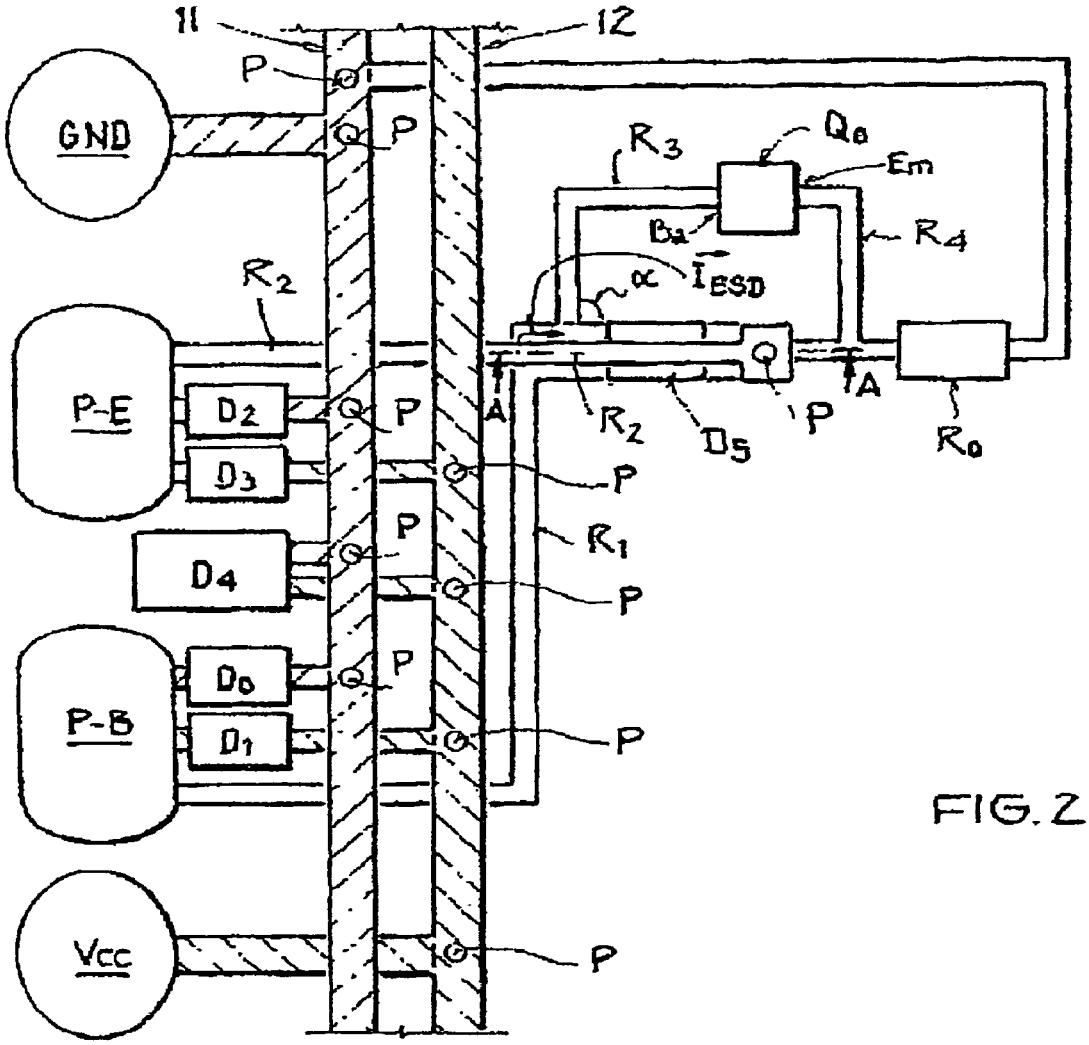
FIG. 2 is a schematic two-dimensional layout with protection structures and a conductive structure of a protection circuit.

FIG. 2 shows a detail of a two-dimensional layout of a protection circuit. Metal tracks 11, 12, R1, R2, R3, and R4 of different metallization levels are drawn one above another in the purely two-dimensional view of FIG. 2. A connection between two or more metallization levels is created by a so-called via P.

On the left side, bond pads are shown as part of the housing terminals GND, P-E, P-B, and Vcc, which are connected, for example, by a bond wire to a metal lug of the housing. Alternatively, solder, which in each case forms the housing terminal, for a flip-chip mounting can also be applied to the bond pads GND, P-E, P-B, and Vcc.

The bond pads GND and Vcc are provided for connection of the supply voltage and connected to bars 11 and 12 to supply the circuits integrated on the semiconductor chip. Furthermore, the first bond pad P-B for the first housing terminal already mentioned in FIG. 1 and the second bond pad P-E for the second housing terminal mentioned in FIG. 1 are shown in FIG. 2.

The protection structures D0 to D4 are positioned directly next to the first bond pad P-B and the second bond pad P-E. These protection structures D0 to D4 are thereby made closer to the first bond pad P-B and to second bond pad P-E than to the p-n junction of bipolar transistor Q0. The first bond pad P-B is connected to the base Ba of bipolar transistor Q0 via a metal track R1 and a metal track R3. The second bond pad P-E is connected to the emitter Em of bipolar transistor Q0 via a metal track R2 and a metal track R4.

The metal track R2 has several straight conductive sections, which connect the first bond pad P-B and the additional protection structure D5. The metal track R3 branches off at an angle a from one of these conductive sections in the same metallization level. Advantageously, the angle a is an obtuse angle. In the exemplary embodiment of FIG. 2, $\alpha$ is a preferred 90° angle.

If it is assumed that an electrostatic discharge introduces an electron discharge into bond pad P-B of the first housing terminal, then, as already described in regard to FIG. 1, a large part of the charge is drawn off via protection structures D0 to D4. A portion of the discharge current $I_{ESD}$, however, flows via metal track R1 in direction of the branch. In the area of the branch, the current direction of the discharge current $I_{ESD}$ is shown schematically by an arrow. The preferential direction for the discharge current $I_{ESD}$ thereby runs across protection structure D5. In order to guide discharge current $I_{ESD}$ in this preferential direction, the branch is provided in the area of a straight conductive section of metal track R1.

A steep discharge pulse of an electrostatic discharge has a significant high-frequency portion. For this pulse, the substantially right-angle branch of the metal track R3 therefore represents an additional impedance, so that the discharge pulse is guided into the straight conductive section of metal track R2.

Figure 3:
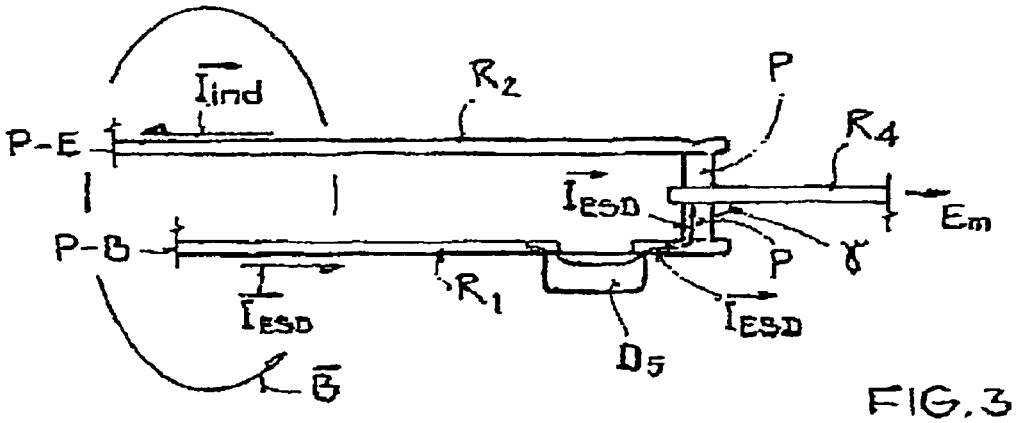
FIG. 3 is a schematic sectional view of a part of a conductive structure of a protection circuit.

Two other geometric measures to guide the direction of discharge current $I_{ESD}$ are shown in FIG. 3, which schematically shows a section along the line A-A through a part of the protection circuit of FIG. 2.

FIG. 3 shows that metal tracks R1 and R2 are formed substantially parallel and close to one another. Silicon dioxide, for example, is introduced as an insulator between metal tracks R1 and R2.

Discharge current $I_{ESD}$ produces a magnetic field, formed radially around metal track R1 with the flux density B, which in metal track R2 induces a current in the opposite direction by inductive coupling. By means of this geometric design of the conductive structure with metal tracks R1 and R2, discharge current $I_{ESD}$ is therefore guided in the desired preferential direction, namely, across protection structure D5 and the two vias P into metal track R2. The depicted inductive coupling naturally also applies to the opposite case, in that discharge current $I_{ESD}$ is to flow from second bond pad P-E to first bond pad P-B in the preferential direction.

Another geometry-determined guiding of discharge current $I_{ESD}$ is achieved by another straight conductive section, which is formed by the two vias P of FIG. 3. Metal track R4 branches off from this straight conductive section at the angle y in a middle metallization level to emitter Em of bipolar transistor Q0. For the pulse of discharge current $I_{ESD}$ as well, the substantially right-angle branch of metal track R4 therefore represents an additional impedance, so that the discharge pulse is guided into the straight conductive section of vias P.

In FIGS. 2 and 3, therefore, different exemplary embodiments for a guiding of discharge current $I_{ESD}$ by a certain geometry of the conductive structure are disclosed. These can be used both individually and preferably also in combination to guide discharge current $I_{ESD}$ in a preferential direction, away from a component to be protected.

The invention is understandably not limited to the shown exemplary embodiments, but also comprises embodiment variants that are not shown. For example, instead of these or in combination, conductive sections of the conductive structure can also be made of highly doped, low-impedance polycrystalline silicon. It is also possible to protect other p-n junctions, for example, a p-n junction of a diode. Other components, for example, a very thin gate oxide, can be protected by a geometric design of the conductive structure to guide the discharge current $I_{ESD}$ in a preferential direction. The invention is also not limited to the layout shown in FIG. 2, but protects all layout variations that utilize the basic concept of the geometric design for guiding the discharge current $I_{ESD}$.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An integrated protection circuit to protect an integrated component against an electrostatic discharge, the circuit comprising:

a conductive structure provided between the integrated component and a housing terminal; and two substantially parallel conductive sections of the conductive structure for guiding the electrostatic discharge in a preferential direction by magnetically inducing current flow in the preferential direction through inductive coupling.

2. The Integrated protection circuit according to claim 1, wherein the conductive structure has a substantially straight conductive section for an electrostatic discharge current and a branch connected to the component to be protected, whereby the branch forms an angle to the substantially straight conductive section.

3. The Integrated protection circuit according to claim 2, wherein the substantially straight conductive section connects the two substantially parallel conductive sections.

4. The integrated protection circuit according to claim 1, wherein the component to be protected has a p-n junction, which is connected to the housing terminal.

5. The Integrated protection circuit according to claim 1, with a first number of integrated protection structures in the connection region of the housing terminal and with a second number of integrated protection structures in the vicinity of the component to be protected.

6. The Integrated protection circuit according to claim 1, wherein the conductive structure connects the component to be protected and the housing terminal.

7. The Integrated protection circuit according to claim 2, wherein the angle is between 45° and 135°.

8. The Integrated protection circuit according to claim 2, wherein the branch and the substantially straight conductive section are formed within one metallization level.

9. The Integrated protection circuit according to claim 2, wherein the substantially straight conductive section is formed by a number of vias and the branch is formed in a metallization level substantially perpendicular to at least one of the number of vias.

10. The Integrated protection circuit according to claim 4, wherein a diode protection structure of the second number of the protection structures is connected antiparallel to the p-n junction.

11. An integrated oscillator circuit for a global positioning system, the circuit comprising:

a p-n junction;

housing terminals for a quartz for connecting to the p-n junction, to generate an oscillator signal; and an integrated protection circuit to protect the p-n junction against an electrostatic discharge, which is connected to a first housing terminal for the n-doped semiconductor region of the p-n junction and with a second housing terminal for the p-doped semiconductor region of the p-n junction, wherein the integrated protection circuit has a first number of integrated protection structures in a connection region of the first housing terminal and of the second housing terminal, wherein the integrated protection circuit has a second number of integrated protection structures in the p-n junction area of the p-n junction, wherein the integrated protection circuit has a conductive structure between the p-n junction and the first housing terminal and/or between the p-n junction and the second housing terminal, and wherein two substantially parallel conductive sections of the conductive structure guide the electrostatic discharge in a preferential direction by magnetically inducing current flow in the preferential direction through inductive coupling.

* * * * *